United States Patent [19]

Roberts et al.

[11] Patent Number: 4,697,930

[45] Date of Patent: Oct. 6, 1987

[54] TRANSFORMERLESS CLOCK CIRCUIT WITH DUPLEX OPTOELECTRONIC DISPLAY

[75] Inventors: Patrick S. Roberts, Rolling Meadows; Leonard Weiss, Grayslake, both of Ill.

[73] Assignee: Spartus Corporation, Skokie, Ill.

[21] Appl. No.: 902,003

[22] Filed: Aug. 28, 1986

Related U.S. Application Data

[63] Continuation-in-part of Ser. No. 881,862, Jul. 8, 1986, abandoned.

[51] Int. Cl.[4] ..... G04C 19/00; G04B 1/00

[52] U.S. Cl. ..... 368/82; 368/204; 340/811

[58] Field of Search ..... 368/10, 11, 82–84, 368/203–204, 239–242; 363/35, 37, 55, 62, 63; 340/805, 811–814; 315/169.3, 221–224

[56] References Cited

U.S. PATENT DOCUMENTS

| | | | |
|---|---|---|---|
| 3,602,795 | 8/1971 | Gunn | 363/62 |
| 4,063,234 | 12/1977 | Arn et al. | 340/805 |
| 4,109,180 | 8/1978 | Ogle et al. | 340/813 |
| 4,201,039 | 5/1980 | Marion | 368/204 |
| 4,595,861 | 6/1986 | Simopoulos et al. | 363/35 |

OTHER PUBLICATIONS

TMS 3450NL LED Duplex Digital Radio Clock Integrated Circuit, pp. 143–156, date unknown.

*Primary Examiner*—Vit W. Miska

*Attorney, Agent, or Firm*—Seidel, Gonda, Goldhammer & Abbott

[57] ABSTRACT

A transformerless power supply and display energizing circuit for a clock circuit with a duplex optoelectronic display driven by a low voltage integrated clock circuit having positive and negative voltage input terminals and the duplex display having a first terminal connected to a first common cathode and a second terminal connected to a second common cathode of the display for energizing it. The transformerless circuit is powered from an AC source. An impedance, which may be either resistive or reactive, reducing the AC voltage to a level suitable for the integrated clock circuit. The transformerless circuit generates synchronous DC level-shifted pulse trains for driving the positive input terminal of the integrated clock circuit alternately between a first voltage and a reference voltage while synchronously driving the display first terminal between said first voltage and a voltage of equal amplitude and opposite polarity. The display second terminal is held at the reference voltage.

34 Claims, 5 Drawing Figures

TRANSFORMERLESS CLOCK CIRCUIT WITH DUPLEX OPTOELECTRONIC DISPLAY

This is a continuation-in-part of co-pending application Ser. No. 881,862 filed on July 8, 1986, now abandoned.

BRIEF DESCRIPTION OF THE INVENTION

This invention relates to clock circuits having a duplex optoelectronic display driven by a low voltage integrated clock circuit, and in particular relates to a transformerless power supply and display energizing circuit for such clock circuits.

BACKGROUND OF THE INVENTION

Clock circuits having a duplex optoelectronic display driven by a low voltage integrated clock circuit are known. Typically, such clock circuits are powered from an AC source, such as conventional 110 V house current. Heretofore, a multitap step-down transformer has been used to reduce the AC voltage to a level suitable for use by the integrated clock circuit. The transformer is provided with two taps for the reduced AC voltage. The reduced voltage is half-wave rectified and supplied to the integrated clock circuit which keeps time, performs alarm functions, and provides decoded outputs to the duplex optoelectronic display. The transformer is also provided with two additional taps by means of which the segments of the duplex optoelectronic display are energized.

It is an object of the present invention to provide a transformerless clock circuit whereby the transformer may be eliminated, thereby reducing the size, weight and cost of the clock circuit.

SUMMARY OF THE INVENTION

The invention is directed to a transformerless power supply and display energizing circuit for a clock circuit having a duplex optoelectronic display driven by a low voltage integrated circuit having positive and negative voltage input terminals, the duplex display having a first terminal connected to a first common cathode thereof and a second terminal connected to a second common cathode thereof for energizing the display. The transformerless circuit comprises means for connecting the circuit to an AC source and means for reducing the AC input voltage to a level usable by the integrated circuit. The circuit has means for applying a reference voltage to the integrated circuit and the display second terminal, and has circuit means connected to the means for reducing the AC voltage, the integrated circuit voltage input terminals and the first and second terminals of the duplex display for driving the positive input terminal of the integrated circuit alternately between a first voltage and a reference voltage while synchronously driving the display first terminal between said first voltage and a voltage of equal amplitude and opposite polarity.

In a preferred embodiment of the invention, the circuit means connected to the means for reducing the AC voltage, the integrated circuit voltage input terminals and the first and second terminals of the duplex display generates synchronous DC level-shifted pulse trains, a first one of the pulse trains alternating between a positive voltage and a reference voltage and being the input to the positive voltage input terminal and a second one of the pulse trains alternating between the reference voltage and a negative voltage and being the input to the negative voltage input terminal for supplying voltage to the integrated circuit while driving the display first terminal between the positive and negative voltages synchronously with the pulse trains.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
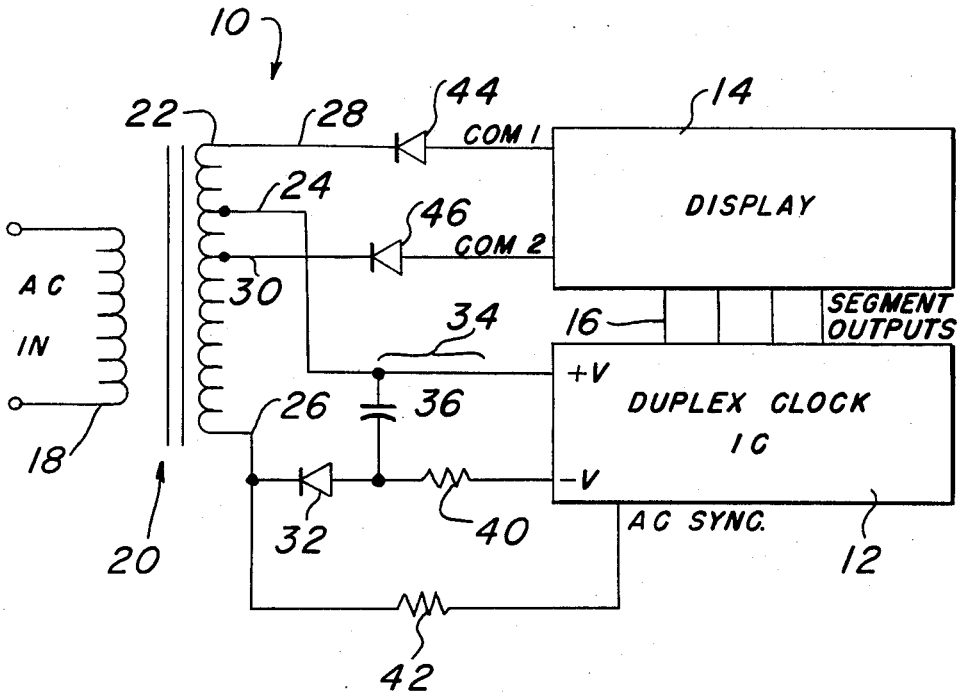
FIG. 1 PRIOR ART
FIG. 1 shows a duplex clock circuit using a transformer, as known in the prior art.

Referring now to the drawings, wherein like numerals indicate like elements, there is shown in FIG. 1 a duplex clock circuit 10 as known in the prior art. The prior art circuit consists primarily of an integrated clock circuit 12, which may be any known duplex integrated clock circuit such as a Texas Instrument TMS3450NL. Clock IC 12 keeps time, performs alarm and other functions, and provides decoded outputs for the segments of an optoelectronic display. The structure and operation of clock IC 12 is well known and understood in the art and, consequently, only so much of its structure and operation as is necessary to understand the present invention will be described. Clock IC 12 drives a duplex optoelectronic display 14 via segment outputs 16. Duplex display 14 may be any known duplex optoelectronic display such as a duplex LED numeric display. Some suitable duplex LED displays include the Sanyo SL-1498T, Toshiba TLR-4262 and Liton LT-637 duplex LED panels. As with clock IC 12, the structure and operation of duplex display 14 is well known and understood in the art and, consequently, only so much of its structure and operation as is necessary to understand the present invention will be described.

AC power is applied to the clock circuit 10 of FIG. 1 via the primary winding 18 of step-down transformer 20. Secondary winding 22 of transformer 20 is provided with four terminals 24, 26, 28 and 30. Terminals 24 and 26 form the stepped-down AC output of transformer 20. The stepped-down AC output is half-wave rectified by diode 32. The half-wave rectified AC output is then applied to the +V and −V voltage input terminals of clock IC 12. The amplitude of the input voltage required will depend upon the particular clock IC 12 used, but will typically be in the range of 7.5 Vdc to 14.0 Vdc.

Terminal 26 of transformer secondary 22 also provides a synchronizing signal to clock IC 12 via resistor 42. The AC synchronizing signal is a time-varying signal which synchronizes clock IC 12 to the alternating half-cycles of the AC input.

As will be understood by those skilled in the art, duplex LED display panel 14 typically contains anywhere from 23 to 28 individual numeric character segments (for the hours and minutes numerals) and 3 or more indicator segments (such as a colon between the hours and minutes numerals and an AM/PM indicator). Each segment must, of course, be provided with two terminals in order to energize it and therefore illuminate it. By providing a common cathode terminal for each of the display segments, the number of terminals required to drive the display segments can be cut almost in half. The number of terminals required can be cut nearly in half again if a duplex scheme, i.e., two common cathodes, is employed. In the duplex circuit shown in FIG. 1, display panel 14 is provided with a first terminal, designated COM 1, which is connected to a first common cathode of display panel 14, and a second terminal, designated COM 2, connected to the second common cathode of display panel 14. In order to energize selected segments of display panel 14, terminals COM 1 and COM 2 are alternately driven to a voltage lower than the +V input voltage to clock IC 12. In the prior art, this is achieved by connecting COM 1 and COM 2 to transformer secondary terminals 28 and 30, respectively, through diodes 44 and 46. COM 1 and COM 2 are driven low on alternate half-cycles of the AC input. Accordingly, those segments of LED panel 14 associated with the common cathode connected to COM 1 are energized during one half-cycle of the AC input, while those segments associated with the common cathode connected to terminal COM 2 are energized during the alternate half-cycle of the AC input. Because transformer secondary terminals 28 and 30 are on either side of transformer secondary terminal 24, terminals 28 and 30 will be alternately higher and lower in voltage than the +V input to clock IC 12. When either COM 1 or COM 2 is lower in voltage than the +V input to clock IC 12, the segments of display panel 14 associated with that common cathode will be energized.

Figure 2:
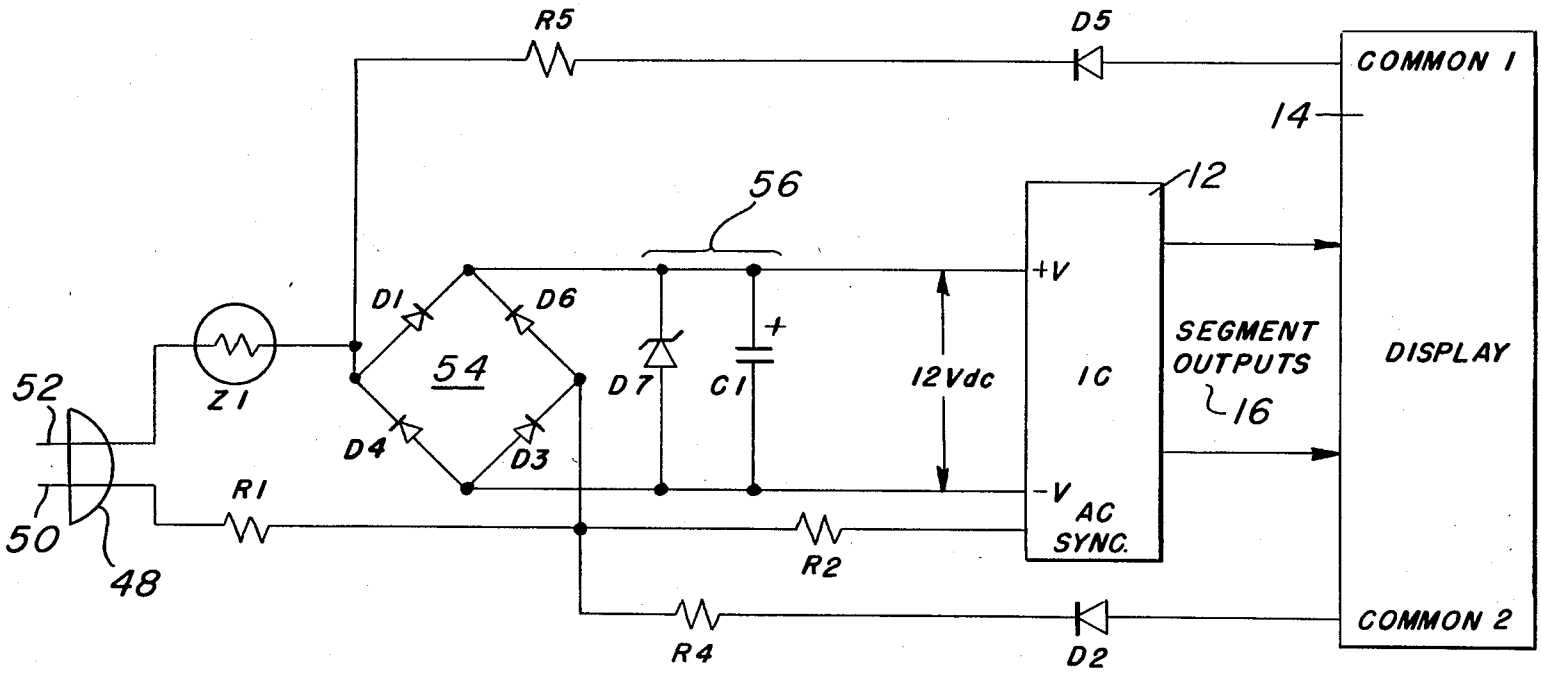
FIG. 2 is a schematic diagram of a circuit according to the present invention.

The circuit of the present invention provides a way of eliminating transformer 20 and providing all of the necessary power supply voltage and display energizing connections using only a pair of input lines. Referring now to FIG. 2, there is shown a transformerless circuit 48 in accordance with the present invention. As seen in FIG. 2, the present invention utilizes a conventional clock IC 12 and LED display panel 14, but supplys voltage and energizing signals to IC 12 and display 14 in a manner significantly different from the prior art.

In the transformerless duplex clock circuit according to the invention the circuit is connected to a source of AC power via plug 48. Plug 48 is a conventional AC plug having two prongs 50 and 52. For purposes of the following description, it will arbitrarily be assumed that prong 50 is connected to the reference side of the AC mains while prong 52 is connected to the "hot" side. Thus, prong 50 will remain at a constant reference voltage while the AC voltage at prong 52 will alternately change polarity. However, those skilled in the art will recognize that it will make no difference if prong 50 were the "hot" lead and prong 52 were the reference.

Instead of being reduced by a step-down transformer, the AC input voltage is reduced to a level usable by clock IC 12 by an impedance element Z1. Impedance element Z1 may preferably be a reactive impedance, for example, a capacitor. If a capacitor, Z1 will have a known impedance at the AC input frequency, and the value of capacitance may be chosen to give any desired reduction in the AC input voltage. Impedance element Z1 may be a resistive impedance, i.e., a resistor, if desired. Although a resistive impedance is within the scope of the present invention, a particular advantage of using a reactive impedance to reduce the input voltage is that, unlike a voltage-dropping resistor, a reactive impedance element does not dissipate power. Therefore, there is no power loss or heat generated from a reactive impedance element.

The reduced AC voltage from Z1 forms one input to a full-wave bridge rectifier 54 which consists of diodes D1, D3, D4 and D6 connected in the well-known bridge rectifier configuration. Bridge rectifier 54 is believed to be well known and understood and need not be described in great detail. The other input of bridge rectifier 54 is returned to the reference terminal 50 of plug 48 via current limiting resistor R1. Resistor R1 limits possible current surges if plug 48 is inserted when the AC mains are at the peak voltage. Resistor R1 also acts as a fuse in the event the impedance element Z1 short circuits.

The full-wave rectified AC voltage at the output terminals of bridge rectifier 54 form the input to voltage regulator circuit 56, which consists of capacitor C1 and voltage regulating diode D7. Voltage regulating circuit 56 smoothes and regulates the full-wave rectified output of bridge rectifier 54 in well-known manner. The regulated output voltage from regulating circuit 56 is applied to the +V and −V voltage inputs of clock IC 12. For purposes of this description, it will be assumed that voltage regulating diode D7 is a 12-volt diode, which means that the difference in voltage between the +V and −V inputs to clock IC 12 will be 12 volts DC. However, it is understood that any suitable voltage, as required by the particular clock IC 12, may be provided.

Clock IC 12 is connected to LED display panel 14 in known manner, as in FIG. 1. Unlike the prior art, however, the AC synchronizing input to clock IC 12 is connected to the reference terminal of the AC input via resistors R2 and R1. Thus, unlike the prior art, the AC synchronizing input to the clock IC 12 does not fluctuate but is held at the reference voltage.

Also unlike the prior art, the input voltages to the +V and −V terminals of clock IC 12 are not constant, but comprise a pair of synchronous DC level-shifted pulse trains. That is, the voltage at the +V input varies from +12 V to the reference voltage and the voltage at the −V input varies from the reference voltage to −12 V synchronously with the voltage at the +V input. Both pulse trains are also synchronous with the AC input signal.

Figure 4:
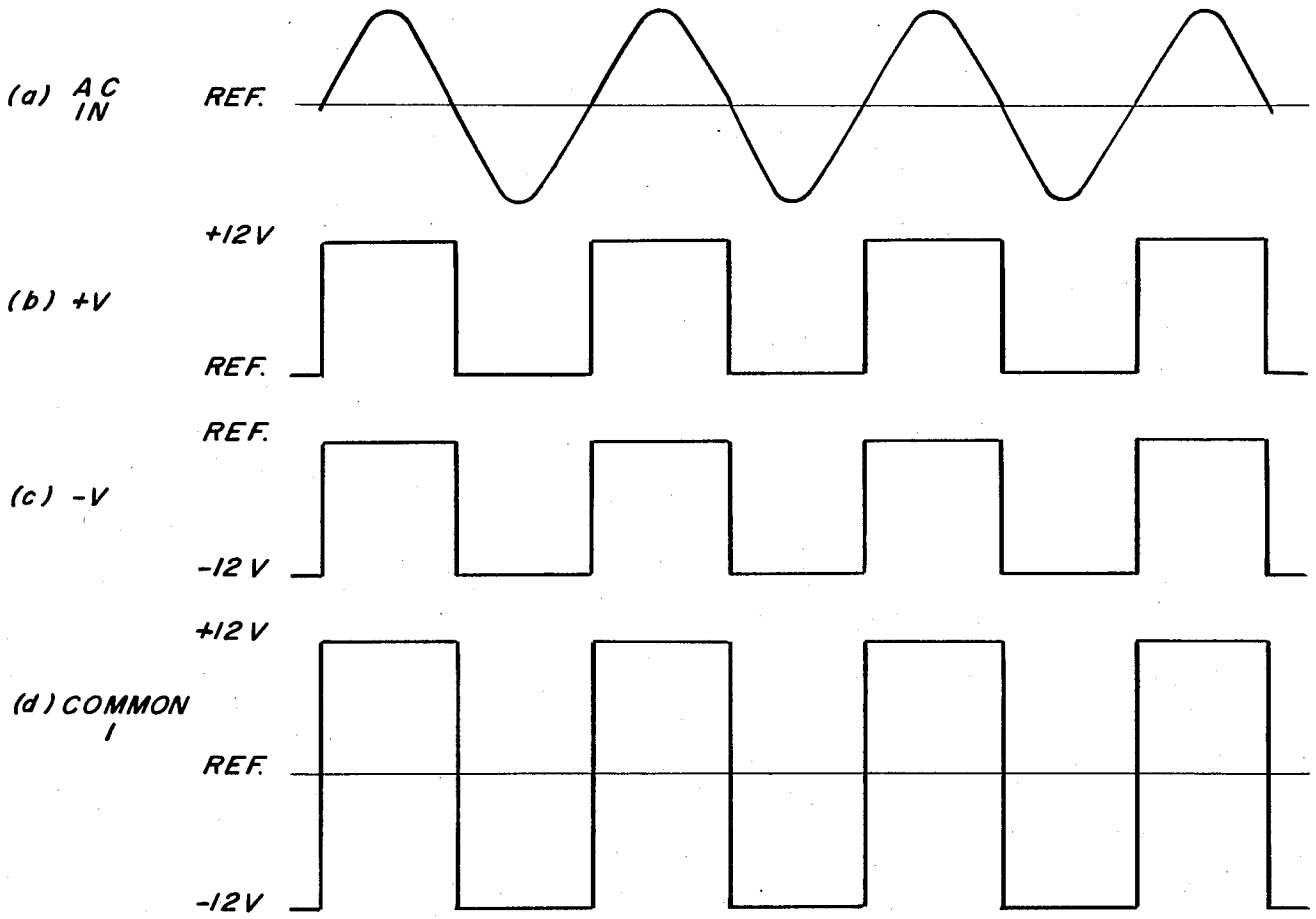
FIG. 4 is a timing diagram of certain waveforms of the circuit of FIG. 2.

Reference to the timing diagram of FIG. 4 will clarify the operation of the circuit of FIG. 2.

The AC input signal at prong 52 of plug 48 is illustrated as waveform (a). During the positive half cycle of the AC input voltage, diodes D1 and D3 will be forward biased. Accordingly, a positive voltage (referenced to the reference voltage at prong 50) will appear at the outputs of bridge rectifier 54. Thus, the +V input of clock IC 12 will be at a voltage of +12 V while the −V input will be at the reference voltage. (To simplify description of the invention, it is assumed that no voltage drop occurs across the diodes. That is, all diodes are assumed to be ideal diodes.)

During the negative half cycle of the AC input voltage, diodes D4 and D6 are forward biased, and hence the +V input to clock IC 12 will be at the reference voltage while the −V input will be at −12 V dc. The +V and −V pulse trains are shown as waveforms (b) and (c) in FIG. 4. It will be noted that waveforms (b)

and (c) are synchronous with each other, and both are synchronous with the AC input signal. However, waveform (c) is DC level-shifted relative to waveform (b). Thus, even though the +V and −V inputs to clock IC 12 change level, there is always a constant 12 V dc voltage across the +V and −V inputs.

Because the +V terminal is driven between a positive voltage and the reference voltage, this alternating level can be utilized to alternately energize the first and second common cathodes of display 14. Clock IC 12 will drive whichever of the two common cathodes of display 14 is lower in voltage than the +V input. The second common cathode COM 2 can be made alternately lower in voltage than the +V input by returning it to the reference voltage via diode D2 and current limiting resistor R4. The voltage at COM 2 will thus always be equal to the reference voltage. During the positive half cycle of the AC waveform, the voltage at the +V terminal of clock IC 12 will be +12 V dc. The +V terminal is thus higher in voltage than the COM 2 terminal, and the second cathode of display 14 will be energized. By returning the first cathode COM 1 to the input side of bridge rectifier 54 via diode D5 and current limiting resistor R5, the voltage at COM 1 will be equal to the voltage at +V during the positive half cycle of the AC input. Accordingly, the first common cathode COM 1 will not be energized. Thus, during the positive half cycle of the AC input, clock IC 12 drives the only second common cathode COM 2 of display 14.

During the negative half cycle of the AC input, the voltage at the +V terminal of clock IC 12 is equal to the reference voltage. Since the voltage at terminal COM 2 of display 14 is also equal to the reference voltage, the second common cathode of display 14 will not be energized. However, since terminal COM 1 of display 14 is returned to the input of bridge rectifier 54, COM 1 will be driven to −12 V dc during the negative half cycle of the AC input. Thus, the voltage at the +V terminal of clock IC 12 will be higher than the voltage at terminal COM 1 of display 14, and the first common cathode will be energized during the negative half cycle of the AC input. The voltage waveform at terminal COM 1 is illustrated as waveform (d) in FIG. 4. It can be readily seen from waveforms (b) and (d) that COM 1 will be energized only during the negative half cycles of the AC input. Since the voltage at terminal COM 2 is always at the reference voltage, it can be seen from waveform (b) that COM 2 will be energized only during positive half cycles of the AC input.

Figure 3:
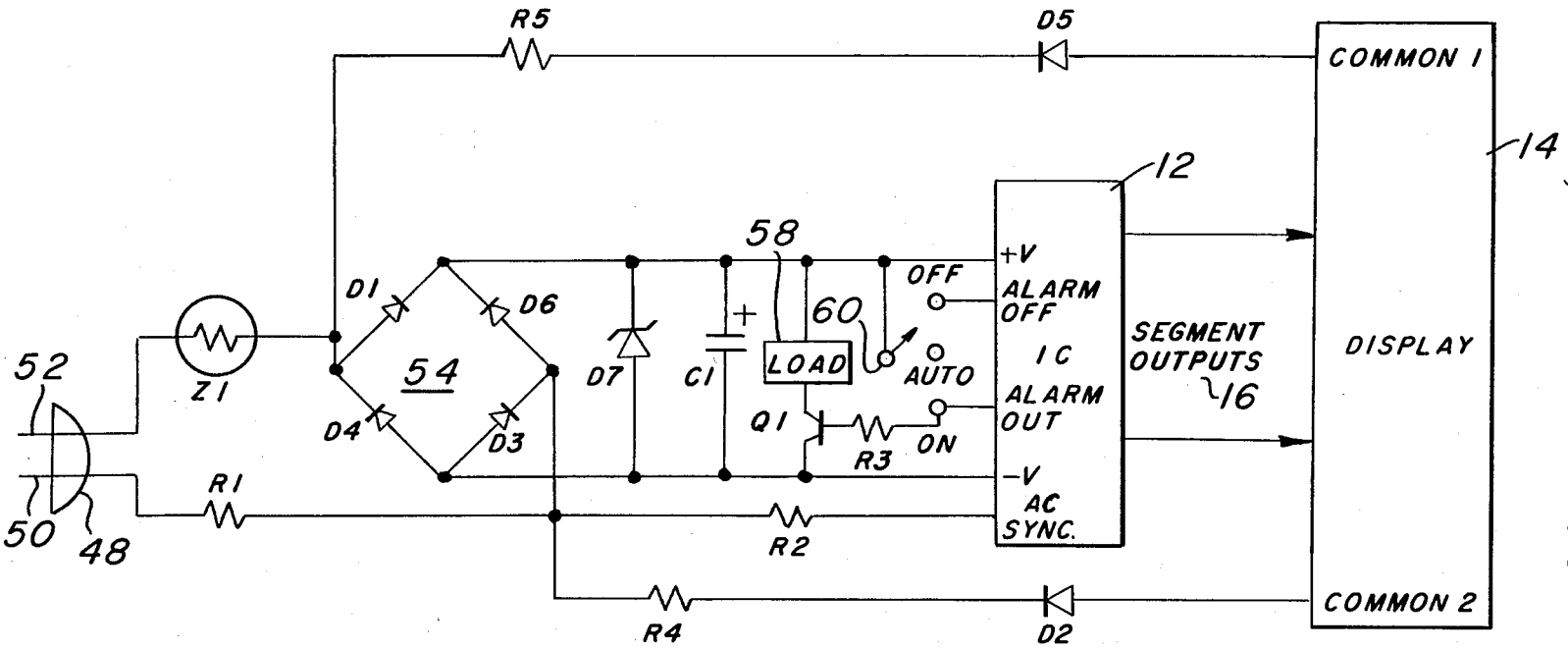
FIG. 3 is a schematic diagram of the circuit of FIG. 2 and further including an auxiliary load.

An alternate embodiment of the invention is shown in FIG. 3. In FIG. 3, an auxiliary load 58 is connected across the +V and −V terminals of clock IC 12. Load 48 may, for example, be the radio in a clock radio or may be the relay coil in an appliance timer. A switch 60 is provided to selectively switch the auxiliary load 58 in and out of circuit. When the switch 60 is in the "ON" position, transistor Q1 is turned on through base resistor R3, and load 58 is energized. When switch 60 is in the "OFF" position, Q1 will be off, and the load will be deenergized. The alarm function of clock IC 12 will also be disabled when switch 60 is "OFF". When switch 60 is in the "AUTO" position, the alarm function of clock IC 12 is enabled. When the real time and alarm time coincide within clock IC 12, the "ALARM OUT" pin of clock IC 12 will output an active high signal, thus turning on transistor Q1 and energizing load 58.

It will be appreciated that, when the load 58 is in the circuit, the additional power consumed by the load must be supplied by decreasing the impedance of impedance element Z1. This can be achieved by any suitable means, such as switching a different impedance element into the circuit in place of Z1 when load 58 is energized. Alternatively, a fixed impedance may be used. In that case, when the load is not energized, the additional power supplied by a fixed impedance element Z1 will be dissipated by voltage regulating diode D7. As another alternative, a dummy load may be switched into the circuit when load 58 is de-energized in order to keep the current in the circuit constant.

Figure 5:
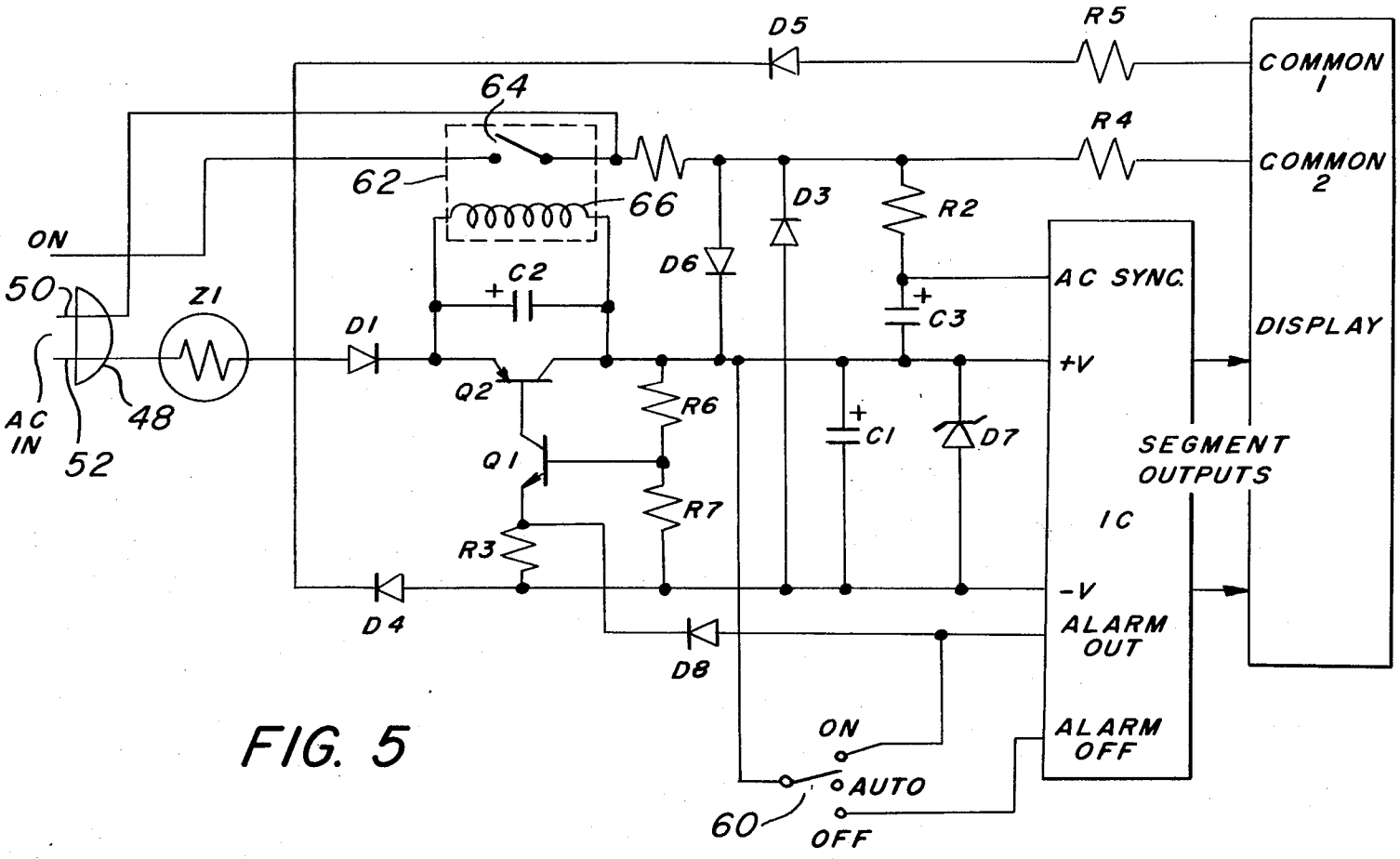
FIG. 5 is a schematic diagram of an alternate embodiment of a circuit according to the present invention, including an auxiliary load.

An alternate embodiment of a circuit according to the present invention including an auxiliary load is shown in FIG. 5. In FIG. 5, an auxiliary load in the form of a relay 62 is connected in circuit with the bridge rectifier 54. Relay 62 comprises relay contacts 64 which may be used to energize and de-energize a load (not shown in FIG. 5) and a relay coil 66. Relay coil 66 is connected between the cathodes of diodes D1 and D6 of bridge rectifier 54. Connected in parallel with relay coil 66 are capacitor C2 and the emitter and collector of transistor Q2. A switching network comprising resistors R3, R6 and R7 and transistor Q1 is connected between the cathodes of diodes D1 and D6 and the anodes of diodes D4 and D3 of bridge rectifier 54. A selector switch 60 is provided as in the circuit of FIG. 3. An additional switching diode D8 is connected between the "ALARM OUT" pin of clock IC 12 and the emitter of transistor Q1. A filter capacitor C3 is provided between the AC SYNC and +V terminals of IC 12.

The unique feature of the circuit shown in FIG. 5 is that it uses voltage normally "thrown away" by impedance element Z1 to drive the relay coil 66. Because of this, the same impedance Z1 used to drive the clock IC 12 is sufficient to also operate relay 62. When the impedance element Z1 comprises a capacitor, this results in a lower cost than the larger capacitor required in the circuit of FIG. 3.

Operation of the circuit of FIG. 5 will now be described.

It is assumed that the circuit of FIG. 5 is first in the "ALARM OFF" mode. The circuit is powered up during the negative half cycle of the AC input. As in the circuits of FIG. 2 and FIG. 3, it will arbitrarily be assumed that prong 50 of plug 48 is connected to the reference side of the AC means while prong 52 is connected to the "hot" side. Thus, prong 50 will remain at a constant reference voltage while the AC voltage at prong 52 will alternately change polarity. However, those skilled in the art will recognize that it will make no difference if prong 50 were the "hot" lead and prong 52 were the reference.

During the negative half cycle, the +V terminal of clock IC12 will be held at the reference voltage through resistor R1 and diode D6. The −V terminal of clock IC 12 will be held at a negative voltage through diode D4 and impedance element Z1. Thus, assuming the same voltage levels as with the circuits of FIGS. 2 and 3, the +V terminal will be at the reference voltage while the −V terminal will be at −12 V dc. As with the circuit of FIGS. 2 and 3, this voltage is regulated by diode D7. During the negative half cycle, capacitor C1 is charged to a voltage differential of 12 volts. Since the positive terminal of capacitor C1 is connected to the +V terminal of clock IC 12, it will be at the reference voltage during the negative half cycle, while the opposite side of capacitor C1 will be at −12 V.

Also during the negative half cycle, there is no conduction path through D1 and Q2. Likewise, there is no conduction through relay coil 66, since diode D1 is reversed biased during the negative half cycle. Thus, relay contacts 64 remain open, and the load is un-energized, as required in an "ALARM OFF" mode.

During the positive half cycle, a positive polarity voltage is present at prong 52. The −V terminal of clock IC 12 is now pulled up to the reference voltage via diode D3 and resistor R1. Similtaneously, because the voltage across capacitor C1 cannot change instantaneously, the +V terminal of clock IC 12 rises to +12 V dc. When the +V terminal rises to +12 V dc, the voltage across resistors R6 and R7 will be +12 V dc. Resistors R6 and R7 can be chosen so that the voltage at the junction of R6 and R7 is sufficient to forward forward bias the base-emitter junction of transistor Q1, and cause Q1 to conduct. When transistor Q1 is turned on, it provides a current path from the base of transistor Q2 through resistor R3 to the reference voltage, thus causing Q2 to conduct. Current now flows from impedance element Z1 through diode D1 and transistor Q2.

Because transistor Q2 conducts during the positive half cycle, it effectively shorts out relay coil 66, so that no current flows through coil 66. Thus, relay contacts 64 remain open and the load is un-energized.

A portion of the current flowing through reactive element Z1 and diode D1 charges capacitor C2 during the positive half cycle.

When the switch 60 is in the "AUTO" position, the alarm function of clock IC 12 is enabled. When the real time and alarm time coincide within clock IC 12, the "ALARM OUT" pin of clock IC 12 will output an active high signal. This active high signal will be applied to the emitter of transistor Q1 through diode D8. Thus, during the positive half cycle of the AC input, the emitter of transistor Q1 will be at a higher potential than the base of Q1, causing transistor Q1, and therefore transistor Q2, to turn off. Since Q2 is off, current will flow from diode D1 through relay coil 66, thereby closing relay contacts 64 and energizing the load. In addition, as already noted, a portion of the current flowing through diode D1 will charge capacitor C2. During the negative half cycle, relay coil 66 would receive no current were it not for capacitor C2. That is, during the negative half cycle, there will be no current flow through diode D1, since D1 would be reverse biased. If current through relay coil 66 were thus interrupted in the negative half cycle, relay contacts 64 would chatter. To prevent this, capacitor C2 is provided. Capacitor C2 discharges through relay coil 66 during the negative half cycles of the AC input, and is chosen to provide sufficient holding current through coil 66 so that contacts 64 remain closed and do not chatter during negative half cycles.

Relay 62 can be energized continuously when switch 60 is in the "ON" position by connecting the common terminal of switch 60 to the +V terminal of clock IC 12, and connecting the "ON" terminal of switch 60 to the anode of diode D8. This ensures that transistors Q1 and Q2 do not conduct, so that relay coil 66 is always energized.

Operation of the remainder of the circuit of FIG. 5 is the same as the circuits of FIGS. 2 and 3.

It has been found that D2 is not absolutely necessary for operation of the invention. Hence, diode D2 may be replaced by a short circuit with no adverse effect on operation of the invention. It has also been found that diode D3 in bridge rectifier 54 may also be eliminated when auxiliary load 58 is not present, as in the circuit of FIG. 2, and may be eliminated in the circuit of FIG. 5. In that event, D3 may be replaced by an open circuit. The display current paths are provided through R4 and R1 for the positive half cycle and through D5, R5 and Z1 for the negative half cycle. However, for the circuit of FIG. 3, where there is a significant auxiliary load 58, D3 is still required.

For safety considerations, the high-voltage components Z1 and R1 can be incorporated in the housing of plug 48. This enables separation of the high-voltage elements from the low-voltage elements of the circuit. However, it is understood that the physical locations of Z1 and R1 are not critical to the present invention.

The present invention may be embodied in other specific forms without departing from the spirit or essential attributes thereof and, accordingly, reference should be made to the appended claims, rather than to the foregoing specification, as indicating the scope of the invention.

We claim:

1. In a clock circuit having a duplex optoelectronic display driven by a low voltage integrated circuit having positive and negative voltage input terminals, the duplex display having a first terminal connected to a first common cathode thereof and a second terminal connected to a second common cathode thereof for energizing the display, a transformerless power supply circuit comprising (a) means for connecting the circuit to an AC source,
(b) means for reducing the AC input voltage to a level usable by the integrated circuit,
(c) means for applying a reference voltage to the integrated circuit and the display second terminal,
(d) circuit means connected to the means for reducing the AC voltage, the integrated circuit voltage input terminals and the first and second terminals of the duplex display for driving the positive input terminal of the integrated circuit alternately between a first voltage and a reference voltage while synchronously driving the display first terminal between said first voltage and a voltage of equal amplitude and opposite polarity.

2. The circuit of claim 1, wherein the means for reducing the AC input voltage comprises a reactive impedance.

3. The circuit of claim 2, wherein the reactive impedance comprises a capacitor.

4. The circuit of claim 1, wherein the circuit means includes a full-wave bridge rectifier.

5. The circuit of claim 1, further comprising regulator circuit means connected between the circuit means and the integrated circuit positive and negative voltage input terminals.

6. The circuit of claim 1, further comprising current limiting means connected to the means for connecting the circuit to an AC source.

7. The circuit of claim 1, further comprising an electrical load across the integrated circuit positive and negative input terminals.

8. The circuit of claim 7, wherein the load is a radio.

9. The circuit of claim 7, wherein the load is a relay coil.

10. The circuit of claim 7, further comprising means for switching the load into and out of circuit.

11. The circuit of claim 1, further comprising means in electrical series with the AC input reducing means for selectably energizing and de-energizing an electrical load.

12. The circuit of claim 11, wherein the means for selectably energizing and de-energizing an electrical load comprises a relay.

13. The circuit of claim 12, further comprising means for actuating the relay, comprising first switch means for controlling the flow of actuation current to the relay and second switch means selectably operable to control the state of the first switch means.

14. In a clock circuit having a duplex optoelectronic display driven by a low voltage integrated circuit having positive and negative voltage input terminals and an AC synchronizing input, the duplex display having a first terminal connected to a first common cathode thereof and a second terminal connected to a second common cathode thereof for energizing the display, a transformerless power supply and display energizing circuit comprising:

(a) means for connecting the circuit to an AC source;
(b) means for reducing the AC input voltage to a level usable by the integrated circuit,
(c) means for applying a reference voltage to the AC synchronizing input of the integrated circuit and the display second terminal,
(d) circuit means connected to the means for reducing the AC voltage, the integrated circuit voltage input terminals and the first and second terminals of the duplex display for generating synchronous DC level-shifted pulse trains, a first one of the pulse trains alternating between a positive voltage and the reference voltage and being the first input to the positive voltage input terminal and a second one of the pulse trains alternating between the reference voltage and a negative voltage and being the input to the negative voltage input terminal, for supplying voltage to the integrated circuit while driving the display first terminal between the positive and negative voltges synchronously with the pulse trains.

15. The circuit of claim 14, wherein the amplitudes of the first and second pulse trains relative to the reference voltage are equal.

16. The circuit of claim 14, wherein the means for reducing the AC input voltage comprises a reactive impedance.

17. The circuit of claim 14, where the circuit means includes a full-wave bridge rectifier.

18. The circuit of claim 14, further comprising regulator circuit means connected between the circuit means and the integrated circuit positive and negative voltage input terminals.

19. The circuit of claim 14, further comprising current limiting means connected to the means for connecting the circuit to an AC source.

20. The circuit of claim 14, further comprising an electrical load across the integrated circuit positive and negative input terminals.

21. The circuit of claim 20, wherein the load is a radio.

22. The circuit of claim 20, wherein the load is a relay coil.

23. The circuit of claim 20, further comprising means for switching the load into and out of circuit.

24. The circuit of claim 14, further comprising means in electrical series with the AC input reducing means for selectably energizing and de-energizing an electrical load.

25. The circuit of claim 24, wherein the means for selectably energizing and de-energizing an electrical load comprises a relay.

26. The circuit of claim 25, further comprising means for actuating the relay, comprising first switch means for controlling the flow of actuation current to the relay and second switch means selectably operable to control the state of the first switch means.

27. In a clock circuit having a duplex optoelectronic display driven by a low voltage integrated circuit having positive and negative voltage input terminals and an AC synchronizing input, the duplex display having a first terminal connected to a first common cathode thereof and a second terminal connected to a second common cathode thereof for energizing the display, a transformerless power supply and display energizing circuit comprising:

(a) means for connecting the circuit to an AC source;
(b) reactive impedance means for reducing the AC input voltage to a level usable by the integrated circuit;
(c) bridge rectifier means connected to the reactive impedance means,
(d) voltage regulator means connected to the bridge rectifier means;
(e) the voltage regulator means being connected to the positive and negative voltage input terminals of the integrated circuit;
(f) the first display terminal being connected to the reactive impedance means and the bridge rectifier means, and
(g) the second display terminal and the AC synchronizing input of the integrated circuit being connected to a reference voltage.

28. The circuit of claim 27, further comprising an electrical load across the integrated circuit positive and negative terminals.

29. The circuit of claim 28, wherein the load is a radio.

30. The circuit of claim 28, wherein the load is a relay coil.

31. The circuit of claim 28, further comprising means for switching the load into and out of circuit.

32. The circuit of claim 27, further comprising means in electrical series with the reactive impedence means for selectably energizing and de-energizing an electrical load.

33. The circuit of claim 32, wherein the means for selectably energizing and de-energizing an electrical load comprises a relay.

34. The circuit of claim 33, further comprising means for actuating the relay, comprising first switch means for controlling the flow of actuation current to the relay and second switch means selectably operable to control the state of the first switch means.

* * * * *